United States Patent [19]

Powers

[11] Patent Number: 4,767,396

[45] Date of Patent: Aug. 30, 1988

[54] METHOD AND APPARATUS FOR PROCESSING BIOLOGICAL FLUIDS

[75] Inventor: Edward T. Powers, Medfield, Mass.

[73] Assignee: Haemonetics Corporation, Braintree, Mass.

[21] Appl. No.: 21,338

[22] Filed: Mar. 3, 1987

[51] Int. Cl.[4] ..... B04B 9/00; B04B 7/02

[52] U.S. Cl. ..... 494/60; 494/84; 604/6

[58] Field of Search ..... 494/60, 84, 83, 46, 494/43, 45; 604/5, 6

[56] References Cited

U.S. PATENT DOCUMENTS

| | | | |
|---|---|---|---|
| 2,497,867 | 2/1950 | Cymmer | 286/29 |
| 3,082,632 | 3/1963 | Vulliez | 74/18.1 |
| 3,145,713 | 8/1964 | Latham, Jr. | 128/214 |
| 3,208,289 | 9/1965 | Hutter et al. | 74/18 |
| 3,317,127 | 5/1967 | Cole | 233/26 |
| 3,371,059 | 2/1968 | Rich | 494/60 |
| 3,409,213 | 11/1968 | Latham, Jr. | 233/21 |
| 3,565,330 | 2/1971 | Latham, Jr. | 233/21 |
| 3,581,981 | 6/1971 | Latham, Jr. | 233/21 |
| 3,706,412 | 12/1972 | Latham, Jr. | 233/1 B |
| 3,775,309 | 11/1973 | Ito et al. | 210/31 C |
| 3,785,549 | 1/1974 | Latham, Jr. | 233/23 R |
| 3,801,142 | 4/1974 | Jones et al. | 285/280 |
| 4,120,448 | 10/1978 | Cullis | 233/22 |
| 4,146,172 | 3/1979 | Cullis et al. | 233/26 |
| 4,300,717 | 11/1981 | Latham, Jr. | 233/1 A |
| 4,353,499 | 10/1982 | Simonds | 494/60 |
| 4,419,089 | 12/1983 | Kolobow et al. | 494/45 |
| 4,425,112 | 1/1984 | Ito | 494/18 |

FOREIGN PATENT DOCUMENTS

| | | |
|---|---|---|
| 337659 | 11/1930 | United Kingdom . |
| 873137 | 4/1959 | United Kingdom . |

*Primary Examiner*—Robert W. Jenkins

*Attorney, Agent, or Firm*—Hamilton, Brook, Smith & Reynolds

[57] ABSTRACT

A method and apparatus for processing biological fluids, such as blood, by centrifugal separation, is described in which no rotary seals are required for introduction of fluids to a centrifuge bowl. Instead, rotary motion from a drive motor is coupled by a coupling means to a driven member extending from an enclosed centrifuge bowl. The coupling means comprises a non-rotational member which translates, or orbits, about the bowl axis. A flexible boot, extending from the coupling means, seals the opening in the enclosure through which the driven member is driven.

19 Claims, 3 Drawing Sheets

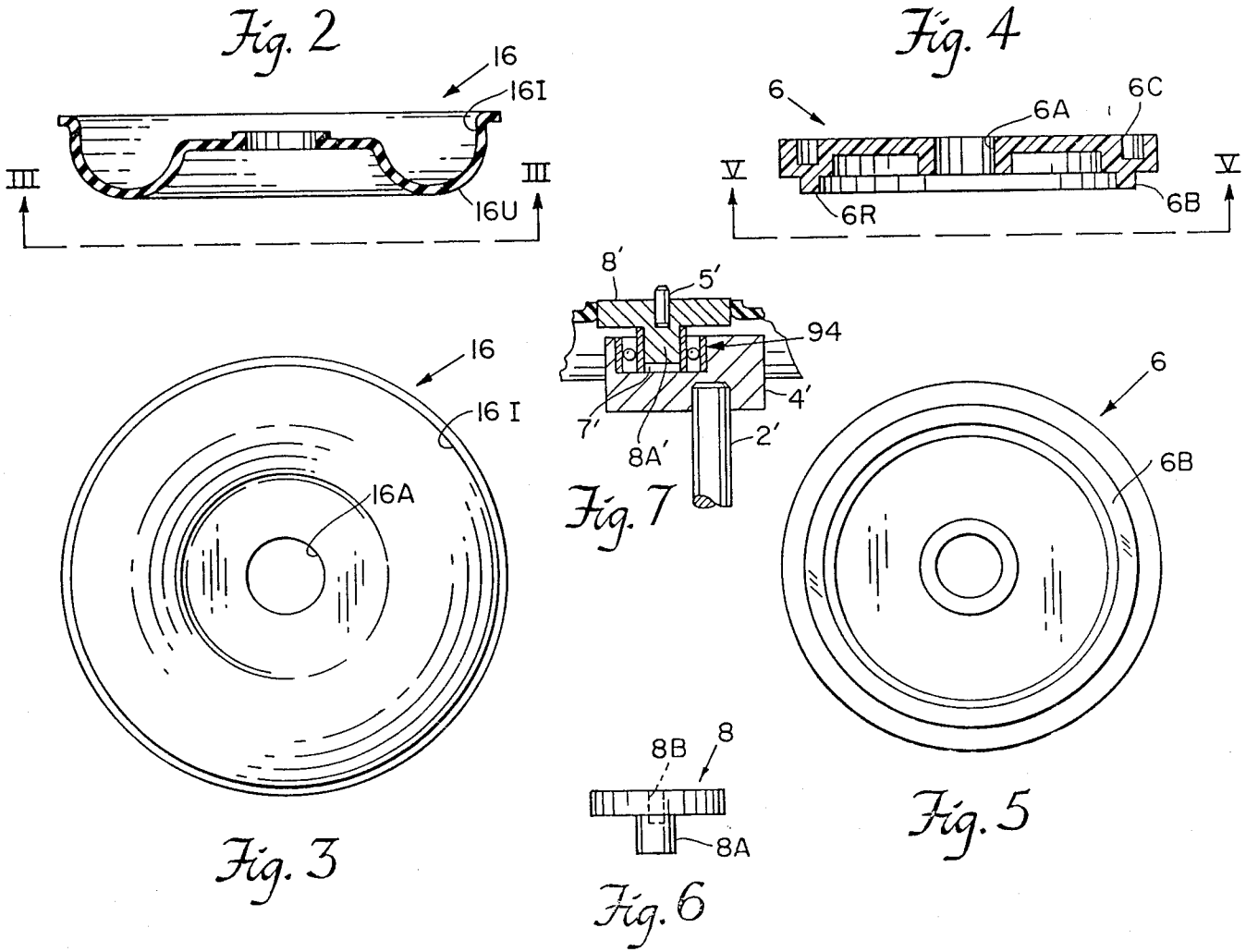
021338

METHOD AND APPARATUS FOR PROCESSING BIOLOGICAL FLUIDS

BACKGROUND ART

This invention relates to a method and apparatus for processing biological fluids, such as blood or suspended cells, and, more specifically, to a disposable centrifuge apparatus in which biological fluids may be separated by being centrifuged. The centrifugal force separates the lighter density biological components from the heavier density biological components. For example, red blood cells, which are heavier, may be separated from plasma or platelet components which are lighter in density.

Since at least the early 1960's, a method and apparatus for the collection, separation and storage of a specific biological fluid, i.e., human blood or its components to use for transfusions and other purposes has been available. A key element in the development of apparatus for the separation of human blood into its component elements, has been the socalled "Latham Bowl". A typical Latham Bowl comprises a rotor in the form of a bowl body which is mounted on a chuck and which is adapted to rotate about a longitudinal axis extending through the bowl.

A core member may be provided within the bowl body to provide a zone between the bowl body and the core, within which the blood is separated into constituent components by the centrifugal forces acting on the blood. Whole blood is introduced into the bowl via a fixed, or stationary, feed tube mounted on a header. The feed tube extends into the bowl and is coaxial with the longitudinal axis of the bowl body.

An outlet, or effluent port, is formed coaxially about the inlet port to allow separated blood components to flow out of the centrifuge bowl. The inlet and outlet ports are connected to fixed members. For example, the inlet port may be connected through sterile tubing to a phlebotomy needle, which may be inserted into a donor for collection of blood. The outlet port may be connected, through sterile tubing, to a sterilized plasma collection container. Because of these connections, both of these ports must remain stationary and cannot be rotated along with the centrifuge bowl.

Accordingly, since their inception, Latham Bowl-type blood centrifuge processors have required some form of rotating seal between the stationary inlet and outlet ports and the rotating centrifuge bowl. (See, for example, U.S. Pat. No. 3,145,713 to A. Latham, Jr. issued Aug. 25, 1964; U.S. Pat. No. 3,317,127, issued May 2, 1967 to R.F. Cole; U.S. Pat. No. 3,409,213 issued Nov. 5, 1968 to A. Latham, Jr.; U.S. Pat. No. 3,565,330 issued Feb. 23, 1971 to A. Latham, Jr.; U.S. Pat. No. 3,581,981 issued June 1, 1971 to A. Latham, Jr.; U.S. Pat. No. 3,706,412 issued Dec. 19, 1972 to A. Latham, Jr.; U.S. Pat. No. 3,785,549 issued Jan. 15, 1974 to A. Latham, Jr.; and U.S. Pat. No. 4,300,717 issued Nov. 17, 1981 to A. Latham, Jr.)

The problem of coupling the fixed ports to the interior of the centrifuge bowl via a rotary seal has been of concern to those skilled in the art over the years. The prior art is replete with the efforts of those skilled in the art to improve the sealing capability of such rotary seals by improving the sealing function and the apparatus for supporting the header in a fixed axial position. The early seals, as embodied in U.S. Pat. No. 3,565,330, employed a rigid, low-friction member, which contacted a moving rigid member with minimal friction, forming a dynamic seal with a secondary elastomeric member which provided a resilient static seal and a spring action force between the surfaces of the dynamic seal.

Another rotary seal suitable for use in blood processing centrifuges is described in U.S. Pat. No. 3,801,142 issued to Jones et al. In this seal, a pair of seal elements, having confronting annular fluid-tight sealing surfaces of non-corrodable material, are provided These are maintained in a rotatable but fluid-tight relationship by axial compression of a length of elastic tubing forming one of the fluid connections to the seal elements. The Belco Company of Mirandola, Italy, developed a rotary seal which is employed in a blood processing centrifuge known as the "BT Bowl". In this seal, a ceramic ring member is attached to rotatable elements of the centrifuge and a fixed graphite ring is attached to stationary centrifuge elements. These ring members are in sealing relationship with each other. Additionally, an elastomeric diaphragm is attached at one end to an adapter ring for the graphite ring and, at the other end, to a stationary part of the centrifuge.

In the rotary centrifuge seal of U.S. Pat. No. 4,300,717, an improved rotary seal is described, which has a rotatable ring member and a non-rotatable ring member with sealing surfaces in sealing engagement with each other and wherein means are provided to entrap solid particulate matter on the side of the seal toward the blood pathway which may be generated at areas of contact between the two ring members during operation of the centrifuge. Further, means are provided for directing entrapped particles back to the area of contact between the ring members, so that the particles are ingested and expelled to the outside.

Despite all these efforts directed towards improving the rotary seal in Latham-type centrifuge bowls, the complexity of the rotary seal still remains a fundamental problem. By their very nature, such seals are difficult to design, manufacture and test. Furthermore, the Federal Drug Administration has not as yet approved blood components processed in such rotary seal-type bowls for use beyond twenty-four hours and, therefore such components cannot now be stored for extended time periods in the United States.

In an effort to overcome the problems associated with rotary seal centrifuge bowls, those skilled in the art have devised complicated systems, such as the so-called "skip rope technique", which enables blood to be coupled in and out of centrifuge containers for processing without requiring the rotary seal found in the prior art Latham bowl devices.

The "skip-rope" seal-less centrifuge is shown in FIG. 2 of U.S. Pat. 4,146,172 to Cullis et al. Basically, this apparatus comprises a rotor drive assembly to which a rotor assembly is journaled by means of a hollow support shaft. The rotor drive assembly is itself journaled to a stationary hub assembly by means of a vertical drive shaft.

A red blood cell separation chamber and a platelet collection chamber are seated on the rotor assembly. Fluid communication is established between the two chambers, which rotate with the rotor assembly, and the non-rotating portions of the processing system, by means of an umbilical cable which extends from a central location along the axis of rotation of the rotor downwardly through the center of the drive shaft, radially outwardly through a guide sleeve, and upwardly to a fixed axially aligned position established by a support arm. The routing of the umbilical cable, together with the rotor assembly and rotor drive assembly are driven in the same direction with a speed ratio of 2:1, to establish fluid communication between the two chambers without the cable becoming twisted. Variations of this "skip-rope" technique are shown in U.S. Pat. Nos. 4,425,112, 4,419,089 and 3,775,309.

The "skip-rope" technique carries its own associated drawbacks. The system is hard to load, requires a large diameter machine for orbiting an arm at half the rotation speed. Such large diameter machines are bulky and awkward, considering the intended use environment, i.e., hospitals. Such machines use a complicated medium gear mechanism and results in wear of the "skip-rope" tubing.

Accordingly, a need exists for a simple centrifuge apparatus and method whereby whole blood may be separated into its constituent components by centrifugal forces without use of rotary seals or complicated "skip-rope" mechanisms.

DISCLOSURE OF THE INVENTION

In the present invention, a method and apparatus for processing blood, or other biological fluids, is disclosed in which an enclosed, disposable, rotatable, fluid processing centrifuge bowl or container, is provided. This container has a driven member affixed thereto which is adapted to rotate about an axis in response to rotary motion coupled from a drive member. A non-rotational enclosure is provided about the rotatable container and the driven member to form a fluid-tight seal completely around the rotatable container, thereby preventing outside contaminants from reaching the inside of the container, or vice versa.

The non-rotational enclosure is comprised of three basic items. The first is a fixed member through which one or more non-rotatable inlet and outlet fluid ports extend into the container. The inlet port(s) provide a sterilizable pathway for fluids to be passed into the container for centrifugal separation into constituent components. The outlet port(s) provide a sterilizable pathway for the separated components to flow out of the container. An opening is formed on said fixed member, through which a mechanical force, in the form of rotational motion, is imparted to the driven member.

An orbiting coupling member forms the second basic item of the enclosure. The coupling member couples, or transfers, rotational motion to the driven member from an external drive member. The coupling member is itself non-rotationally translatable about the bowl axis; that is, it orbits about the bowl axis, but does not rotate.

The third item of the enclosure comprises a flexible tubular member, or boot, extending from the axial opening in the fixed member to the coupling member for forming a fluid-tight seal around the axial opening and the coupling member.

Rotary motion of the drive member is applied to the coupling member, where it is converted, or translated, by the coupling member into a non-rotational orbiting motion and then back to rotary motion of the driven member affixed to the rotatable bowl. In this manner, rotary motion from an external drive motor is coupled through a fixed, or stationary, outer enclosure to cause rotary motion of a centrifuge bowl, or container, within the fixed member; without requiring a rotary seal and the resultant problems associated therewith.

These and other advantages will become apparent from the following description of a preferred embodiment of the invention.

BRIEF DESCRIPTION OF THE DRAWINGS

FIG. 2 is a cross-sectional detail of the flexible member 16.

FIG. 3 is a plane view taken along the lines III—III of FIG. 2.

FIG. 4 is a cross-sectional detail of the alignment base 6.

FIG. 5 is a plane view taken along lines V—V of FIG. 4.

FIG. 6 is an elevational view of the coupling device 8.

FIG. 7 is a cross-sectional detail of an alternate embodiment of FIG. 1 wherein an optional bearing is provided between the bore in drive member 4 and the coupling device 8.

BEST MODE OF CARRYING OUT THE INVENTION

Figure 1:
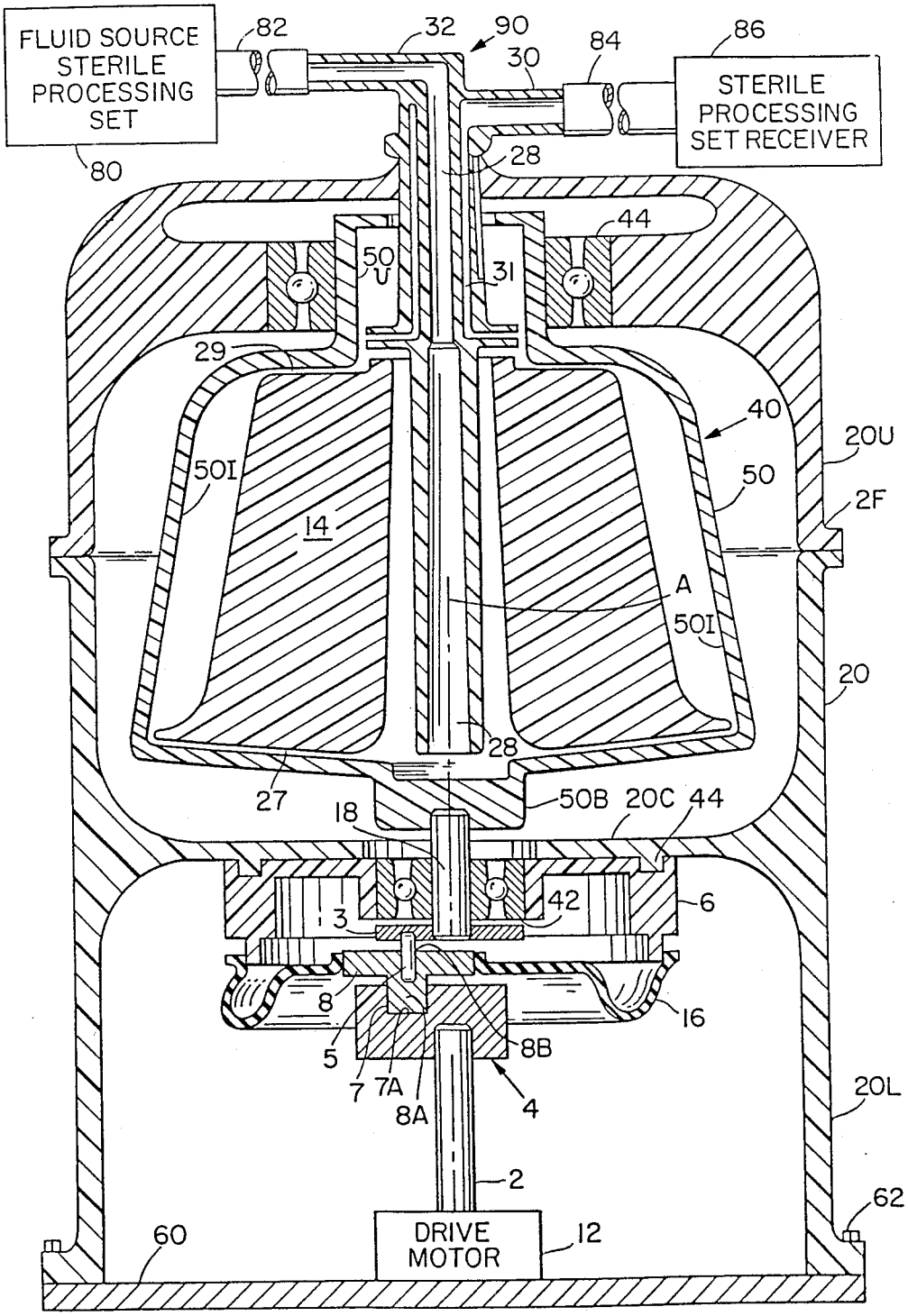
FIG. 1 is a partially schematic longitudinal section of the centrifuge apparatus of the invention shown connected to blood processing sets.

Referring now to the drawings, a preferred embodiment of the invention will now be described. It should be noted that for convenience, blood processing is illustrated in the description, but other biological fluid separation, or handling, processes are contemplated as applications for this invention.

In the apparatus of the drawing, a rotary drive motor 12 is coupled to a drive shaft 2, preferably aligned with the bowl axis A. Shaft 2, in turn, is rotationally coupled to cylindrical rotary drive member 4. Cylindrical rotary drive member 4 has an eccentric bore 7 extending to surface 7A.

A driven shaft 18 is affixed to the rotatable bowl 40 and is also longitudinally aligned with the bowl axis A opposite drive shaft 2. Plate 3 is concentrically mounted on driven shaft 18. A pin 5 is formed in an eccentric bore on plate 3 and extends into a concentric bore 8B in coupling device 8. A bearing surface is provided at the interface of pin 5 and bore 8B.

As shown more clearly in FIG. 6, device 8 is a cylindrical graphite member having a concentric bore 8B on one side and a protruding cylindrical stud 8A on an opposite side. Stud 8A seats in the eccentric bore 7 of member 4. A bearing surface is formed at the interface between stud 8A and bore 7. Device 8 is thus removably and slideably mounted in rotary cylinder device member 4, making the entire assembly above member 4 part of a sterile disposable blood processing kit. The lower assembly, comprising member 4, shaft 2, drive motor 12 and plate 60, may be retained and repeatedly used with new disposables.

It should be noted that the rotary motion of drive shaft 2 and driven member 4 is translated into precessing motion of device 8 and back again into rotary motion of driven shaft 18. Device 8, however, does not itself rotate. Rather, it translates or precesses about the bowl axis "A".

A flexible boot 16 (See FIG. 2) of resilient impermeable material, such as silicone or rubber, extends from the upper periphery of device 8 to the lower periphery of alignment base 6. Boot 16 thus forms a flexible fluid-tight enclosure about the periphery of device 8 and the shaft opening for the driven member through fixed enclosure 20. Boot 16 flexes as device 8 orbits about axis A. A fixed plastic envelope 20 completes the air-tight path about the entire centrifuge bowl 40. This air-tight path prevents airborne contaminants, such as bacteria, from entering the bowl 40, so that once the interior of the bowl, and associated processing set(s) and conduits, is sterilized, in a conventional manner, they will remain sterilized.

An optional alignment base 6 retains lower bearings 42, and mates with a circular channel 44 formed on cross member 20C of enclosure 20.

Enclosure 20 may be conveniently comprised of an upper and lower plastic, transparent, spherical shell 20U and 20L, respectively, joined together at flanges 20F, which may be bonded together in a well-known manner. Prior to bonding the upper half 20U of the enclosure to the lower half 20L, a centrifuge bowl 40 is mounted on driven member 18, such as by being pinned or otherwise affixed in a conventional manner.

The centrifuge rotor or bowl 40 may comprise a bowl-shape member 50 having top upper vertical portion 50U to which is attached upper bearings 44. Bearings 44 and 42 hold the centrifuge bowl 40 in a rotatable fashion about the central longitudinal axis A of the drive axle 2. An optional core member 14 is affixed to the inner centrifuge bowl 40, in the conventional manner, and input and output ports 32 and 30 in header 90 are attached or formed to, or on, the fixed enclosure 20. The ports are provided with central passageways 31 and 28 concentric with the longitudinal axis of the bowl 40.

The enclosure 20 may optionally be provided with lower skirts 20L and removably mounted on base plate 60 by bolts 62. In this manner, a completely self-contained transportable centrifuge is provided with no exposed rotating parts, and in which no separate external containment device is required to contain biological fluids, in the event the bowl 40 should rupture in operation.

The outer enclosure 20 is preferably made of plastic material, such as polycarbonate. As previously stated, the enclosure 20, with the bowl 40, coupling member 8, boot 16, and associated hardware, forms a disposable assembly. After use, this assembly may be removed and discarded by sliding the assembly out of the bore 7 in drive cylinder 4 after unbolting the enclosure from base plate 60.

In operation, anticoagulated whole blood, such as blood from a donor, may be provided to the centrifuge bowl 40 from a sterile processing set 80 which includes phlebotomy needle 500 coupled to tubing 82 The whole blood is coupled via tubing 82 to input port 32. The whole blood is passes through input port 32 down longitudinal passageway 28 into the bottom of the centrifuge bowl 40. Driven member 18 is rotated by engaging drive motor 12 coupled by coupling member 8 to shaft 18. The bowl rotates and the whole blood is caused, by centrifugal force to move outwardly through pathway 27 against the inner walls of the centrifuge bowl 40 between the core 14 and the inner walls 50I of the bowl body 50.

Figure 8:
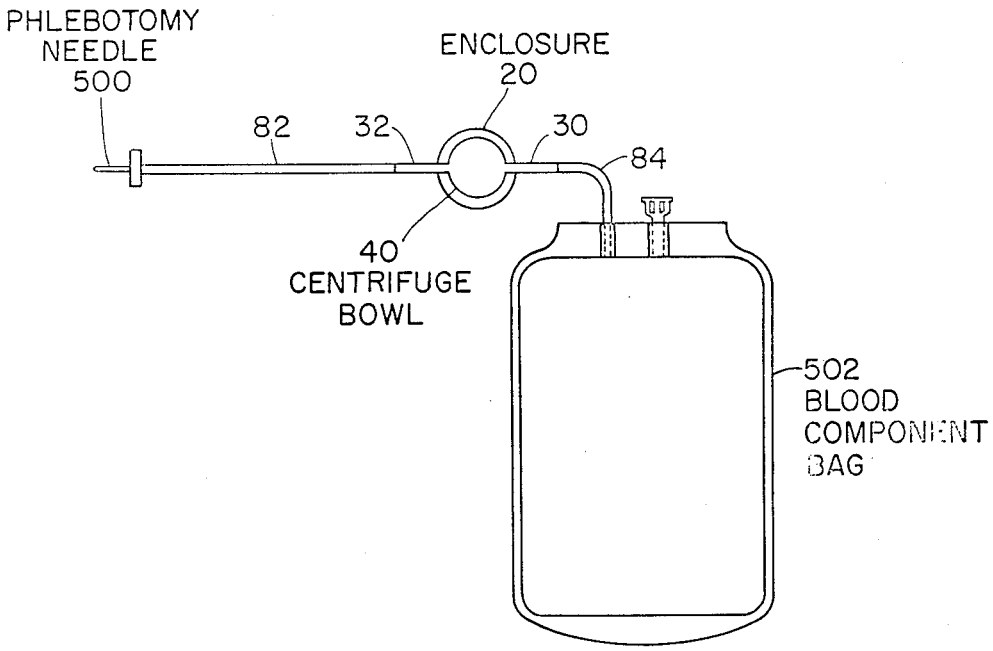
FIG. 8 is a schematic showing certain details of the source and receiver sets 80 and 86, respectively, of FIG. 1.

Less dense blood components enter the passageway 29 between the core 14 and the inner wall 50I of bowl body 50 and pass into the upper concentric passageway 31 leading to output port 30. There, they may be coupled via tubing 84 to a sterile processing receiver set 86, such as a plasmapheresis bag or a plateletpheresis bag 502 (see FIG. 8) for storage; or may be returned to the donor.

The enclosed bowl with coupling means 8 may be connected by tubing to blood processing sets 80 and 86 and the entire disposable system sterilized in a conventional manner prior to being seated in the drive cylinder 4; thus assuring complete sterility of the system in advance of usage.

Details of the boot 16 and alignment base 6 are shown in FIGS. 2–5. Preferably, boot 16 is a low profile, one-piece flexible member, having a central opening 16A, which forms a snap-on fluid tight fit 16A around the periphery of graphite coupling device 8. U-shaped cross-sections 16U provide necessary lateral flexibility to permit device 8 to orbit about the central bowl axis A, yet retain a fluid tight seal. The inner peripheral surface 16I of boot 16 forms a fluid tight fit which is bonded to the outer periphery 6B of extension ring 6R of base 6.

Base 6 has a central opening 6A within which bearings 42 are mounted for rotatably supporting driven member 18. A circular channel 6C is formed in base 6. This channel mates with a circular projection 44 in cross-piece 20C to align the boot and coupling member with the fixed enclosure 20.

There is thus provided a method and apparatus for converting the rotation of drive member 2 about the bowl axis to a rotary motion of the driven member 18 affixed to the rotary bowl 40 through a fixed outer enclosure 20, without the necessity for a rotary seal and the resulting complexity associated therewith.

Equivalents

This completes the description of the preferred embodiment of the invention. Those skilled in the art may recognize other equivalents to the specific embodiment described herein, which equivalents are intended to be encompassed by the claims attached hereto. For example, the apparatus is shown with separate upper and lower bearings 44 and 42 for the bowl 40. It may be less expensive to form the bowl and enclosure with surfaces of bearing contact material. Conversely, it may be desirable, in some applications, to provide separate bearings 94 between stud 8A′ and bore 7′, as shown in the optional embodiment of FIG. 7, to reduce friction and consequent heating at this surface. Note that like parts in FIG. 7 carry the same numeral designations as in FIG. 1, with a prime suffix.

Additional inlet and outlet ports may be readily provided by insertion through enclosure 20 for introducing or extracting processing fluids, since no rotary seals are required. Conversely, a single port may be used for introduction and expulsion of fluids. The drive motor 12, and associated coupling members, need not be aligned with the bowl axis, but may be offset using conventional gearing mechanisms.

The foregoing description relates to an illustrative embodiment of the invention. Other embodiments and equivalents are possible within the scope of the invention, as defined by the following claims.

I claim:

1. Apparatus for processing biological fluids by centrifugal separation comprising:

(a) a fluid processing container having a driven member affixed thereto and adapted to rotate about an axis when driven by a drive member;

(b) an enclosure about said container; said enclosure comprising:
(i) a fixed member;
(ii) an opening in said fixed member through which said driven member is driven;
(iii) coupling means for mechanically coupling external rotary motion to the driven member, said coupling means being non-rotationally translatable about said axis;
(iv) sealing means for providing a fluid-tight seal between the fixed member and coupling means thereby enclosing said opening.

2. The apparatus of claim 1 wherein the biological fluid is blood.

3. The apparatus of claim 1 wherein the sealing means comprises a flexible boot extending from the coupling means to, and around, the opening.

4. The apparatus of claim 1 wherein the coupling means comprises a body having a concentric bore within which an eccentric pin, coupled to said driven member, is rotatably disposed and a concentric stud oppositely disposed from said bore for insertion into an eccentric bore coupled to said drive member.

5. A disposable biological fluid processing system comprising:
(a) a fluid processing set;
(b) a fluid processing container having a driven member affixed thereto and adapted to rotate about an axis; and
(c) an enclosure about said container; said enclosure comprising:
(i) a fixed member having port means coupled to said set for introduction and expulsion of said fluid into and from said container;
(ii) an opening in said fixed member through which said driven member may be driven;
(iii) coupling means non-rotationally translatable about said axis for mechanically coupling external rotary motion to the driven member; and
(iv) sealing means for enclosing the opening in said fixed member.

6. The system of claim 5 wherein the fluid is blood, the source set includes a phlebotomy needle and the receiver set includes a platelet bag.

7. Apparatus for processing biological fluids by subjecting such fluids to a centrifugal force, comprising:
(a) a fluid processing container adapted to rotate about an axis and having a driven member affixed thereto;
(b) a drive member aligned with said axis; and
(c) an enclosure about said container forming a non-rotational fluid-tight seal about said container; said enclosure comprising:
(i) a fixed member;
(ii) an opening formed on said fixed member through which said driven member is driven; and
(iii) a coupling member for mechanically coupling rotational motion from the drive member to the driven member, said coupling member being removably coupled to said drive member and non-rotationally translatable about the container axis;
(iv) and a flexible sealing member extending between the fixed member and coupling member forming a fluid-tight seal enclosing said opening.

8. The apparatus of claim 7 wherein the fixed member extends about said coupling member and drive member to form a shield around all moving members.

9. The apparatus of claims 5 or 7 wherein the biological fluid is blood.

10. The apparatus of claims 5 or 7 wherein the sealing means comprises a flexible boot extending from the coupling member to, and around, the opening.

11. The apparatus of claims 5 or 7 wherein the coupling member comprises a graphite body having a concentric bore and a concentric stud and wherein the driven member includes an eccentric pin inserted into said bore and the drive member includes an eccentric bore receiving said stud.

12. Apparatus for processing blood by subjecting blood to a rotational centrifugal force, comprising:
(a) a drive member;
(b) a blood processing container adapted to be rotated about an axis upon being driven by a driven member; and
(c) an enclosure about said container; said enclosure comprising:
(i) a fixed member;
(ii) an opening formed in said fixed member through which the driven member is driven;
(iii) coupling means for mechanically coupling rotational motion from said drive member to the driven member through said opening, said coupling means being non-rotationally translatable about said axis;
(iv) and a flexible member extending between the fixed member and the enclosure for forming a fluid-tight seal enclosing said opening.

13. A disposable biological fluid processing system comprising:
(a) a fluid processing source set;
(b) a fluid processing receiver set;
(c) a fluid processing container having a driven member affixed thereto and adapted to rotate about an axis; and
(d) an enclosure about said container; said enclosure comprising:
(i) a fixed member having an input port extending into said container and coupled to said source set and an output port extending into said container and coupled to said receiver set;
(ii) an opening in said fixed member through which said driven member is driven;
(iii) coupling means non-rotationally translatable about said axis for mechanically coupling external rotary motion to the driven member; and
(iv) sealing means for enclosing the opening in said fixed member.

14. The system of claim 13 wherein the fluid is blood, the source set includes a phlebotomy needle and the receiver set is a blood component bag.

15. Apparatus for processing blood by subjecting blood to a centrifugal force, comprising:
(a) a drive member;
(b) a blood processing container adapted to be rotated about an axis upon being driven by a driven member affixed thereto; and
(c) an enclosure about said container; said enclosure comprising:
(i) a fixed member through which non-rotatable port(s) extend to the container for coupling said blood to said container;

(ii) an opening formed in said fixed member through which the driven member is driven;

(iii) coupling means for coupling rotational motion from said drive member to the driven member through the opening, said coupling means being non-rotationally translatable about said axis;

(iv) and a flexible member extending between the fixed member and the coupling means for forming a fluid-tight seal enclosing the opening.

16. A blood processing centrifuge system having a rotary container in which blood is processed, said system comprising:

(a) stationary port means for providing a fluid path to or from said container;

(b) a stationary enclosure about said container through which said port means extends; and (c) coupling means for mechanically coupling rotary motion, external to said stationary enclosure, to said container for rotating said container and wherein the coupling means comprises a member which orbits about the axis of rotation of the container and which is eccentrically coupled to said external rotary motion and said rotary container.

17. The system of claim 16 including a flexible member extending between said coupling means and said stationary enclosure.

18. A blood processing centrifuge system having a central axis of rotation having a centrifuge bowl rotatable about said axis with at least one conduit for providing fluid communication to the interior of the bowl, said conduit being non-rotatably coupled to said bowl through a stationary enclosure about said bowl and coupling means comprising a member which orbits about said axis for mechanically coupling external rotary motion through said enclosure to said bowl to rotate said bowl about said axis.

19. The centrifuge system of claim 18 wherein the coupling means is removably eccentrically coupled to said enclosure between an external rotary drive member and an internal rotary driven member affixed to said bowl.

* * * * *